United States Patent [19]

Wood

[11] Patent Number: 4,935,851

[45] Date of Patent: Jun. 19, 1990

[54] ILLUMINATED SHOELACE AND THE LIKE

[75] Inventor: John Wood, Chico, Calif.

[73] Assignees: John D. Little; Lorianne Little, both of Rido Isle, Calif.

[21] Appl. No.: 119,643

[22] Filed: Nov. 12, 1987

[51] Int. Cl.[5] ..... F21L 15/08

[52] U.S. Cl. ..... 362/103; 362/800; 362/806; 362/234; 362/190; 439/859; 24/715.4

[58] Field of Search ..... 362/103, 104, 109, 234, 362/253, 190, 806, 184, 800, 234, 251, 157; 24/143 A, 143 R; 437/846, 818, 823, 848, 859

[56] References Cited

U.S. PATENT DOCUMENTS

| | | | |
|---|---|---|---|
| 2,404,176 | 7/1946 | Huelster | 439/846 |
| 2,632,093 | 3/1953 | Merolis et al. | 362/103 |
| 3,501,628 | 4/1970 | Madden | 362/104 |
| 3,559,251 | 2/1971 | Wilson | 24/143 |
| 4,035,630 | 4/1977 | Burke | 362/104 |
| 4,173,201 | 11/1979 | Chao et al. | 362/103 |
| 4,216,464 | 8/1980 | Terry | 362/103 |
| 4,423,539 | 1/1984 | Ivanhoe | 24/143 |
| 4,425,600 | 1/1984 | Barnhart | 362/103 |
| 4,438,482 | 3/1984 | Leon et al. | 362/190 |
| 4,480,293 | 10/1984 | Wells | 362/103 |
| 4,599,682 | 7/1986 | Stephens | 362/103 |

*Primary Examiner*—Ira S. Lazarus
*Assistant Examiner*—D. M. Cox
*Attorney, Agent, or Firm*—Hubbard, Thurman, Turner, Tucker & Harris

[57] ABSTRACT

An illuminated shoelace including an elongated section of flexible material having first and second ends, and first and second light-emitting elements respectively secured to such first and second ends. The illuminated shoelace further includes a battery holder with an integral electrical switch secured to the elongated section of flexible material, and conductive elements coupled between the battery holder and the light-emitting elements.

13 Claims, 1 Drawing Sheet

ILLUMINATED SHOELACE AND THE LIKE

BACKGROUND OF THE INVENTION

The disclosed invention generally relates to articles with light-emitting elements associated therewith, and is more particularly directed to a shoelace having light-emitting elements at its tips.

Various articles of clothing have been decorated with various forms of light-emitting elements, such as light-emitting diodes. Examples of such articles of clothing have included gloves, belts, jackets, dresses and sweatshirts. The use of light-emitting elements on such articles of wearing apparel has been generally for decorative purposes and to some degree for safety purposes. However, known clothing articles having light-emitting elements have generally been large articles with extensive light emitting elements.

SUMMARY OF THE INVENTION

It would therefore be an advantage to provide a small article of clothing having light-emitting elements attached thereto.

It would also be an advantage to provide a small article of clothing having small light-emitting elements attached thereto.

Another advantage would be to provide a small article of clothing which includes small light-emitting elements which are readily noticeable.

The foregoing and other advantages are provided by the illuminated shoelace of the invention which includes an elongated section of flexible material having first and second ends, and first and second light-emitting elements respectively secured to such first and second ends. The illuminated shoelace further includes a battery holder with an integral electrical switch secured to the elongated section of flexible material, and conductive elements coupled between the battery holder and the light-emitting elements.

BRIEF DESCRIPTION OF THE DRAWING

The advantages and features of the disclosed invention will readily be appreciated by persons skilled in the art from the following detailed description when read in conjunction with the drawing wherein.

DETAILED DESCRIPTION

Figure 1:
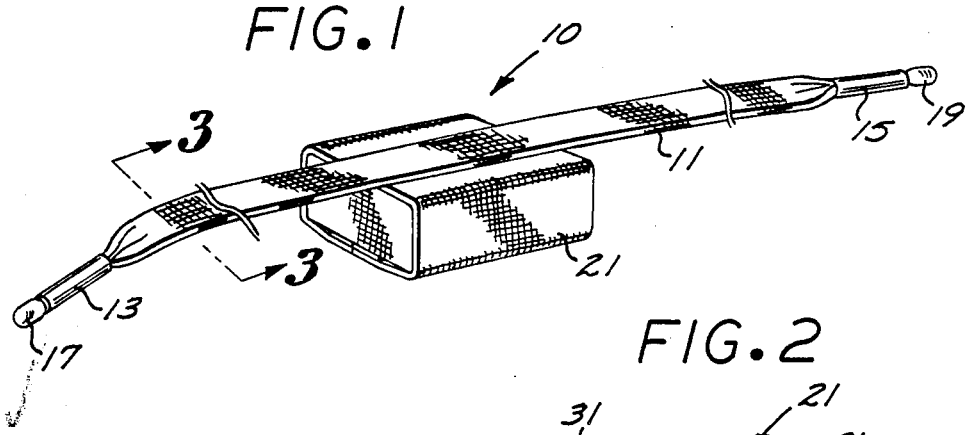
FIG. 1 is a perspective view of a shoelace structure having light-emitting elements at its respective ends.

In the following detailed description and in the several figures of the drawing, like elements are identified with like reference numerals.

Referring now to FIG. 1, illustrated therein is a shoelace structure 10 which includes a flexible shoelace 11 of predetermined length and having shoelace tips 11, 15 at each end. Extending outwardly from each of the free ends of the shoelace tips 13, 15 are respective light-emitting elements 17, 19. A battery holder 21 is secured to the shoelace 11 at a location that is generally centrally between the shoelace tips 15, 17.

Figure 2:
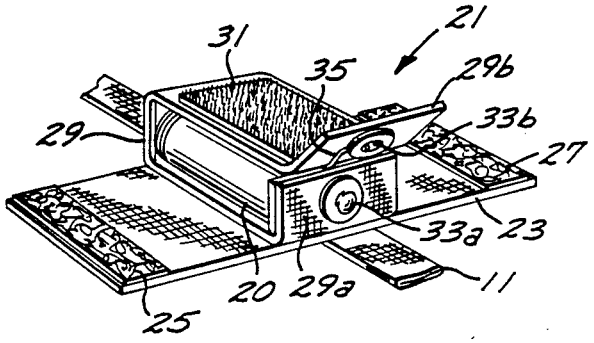
FIG. 2 is a detail perspective view of the battery holder of the shoelace of FIG. 1.

Referring more particularly to FIG. 2, the battery holder 21 is adapted to hold a standard 9 volt transistor battery, schematically illustrated with the reference numeral 20, and generally includes a flexible outside cover 23 which can comprise an appropriately sized, rectangular section of flexible material. The width of the outside cover 23 is selected to be roughly the same as the length of the 9 volt battery 20, while the length of the outside cover 23 is selected to be slightly greater than the dimension transversely around a 9 volt battery. The loop portions 25, 27 of a hook and loop fastening system (for example, Velcro brand fasteners) are secured to the opposing narrower ends of the outside cover 23. The outside cover 23 is secured to the shoelace 11 at location that is generally centrally located between the loop portions 25, 27, with the shoe lace 11 extending laterally across the the width dimension of the outside cover 23.

The battery holder 21 further includes an inside cover 29 which comprises an elongated, rectangular section of flexible material which is adapted to be folded about the battery 20 in the longitudinal direction of the battery. One end of the inside cover 29 comprises a first flap section 29A, while the other end of the inside cover 29 comprises a flap section 29B. A panel of the inside battery cover 29 contiguous to the flap section 29*a* is generally centrally secured to the outside battery cover 23, with such panel extend across the width dimension of the outside cover 23. A hook portion 31 of a hook and loop fastening system is secured to the outside portion of the inside cover 29 panel that is opposite the panel adjacent to the outside cover 23.

A standard polarized two terminal battery connector (not shown) for a 9 volt battery is secured to the inside of the flap section 29*a*. Mating snap closure portions 33*a*, 33*b* are respectively secured to outside of the the inside cover flaps 29*a*, 29*b*. The snap closure portion 33*a* is electrically coupled, for example, to the terminal of the battery connector for the negative terminal of the battery 20. The snap closure portion 33*b* is coupled to a wire 35*a*, which as discussed further relative to FIGS. 4 and 5, forms a circuit with the light emitting elements 17, 19.

In use, the battery 20 is connected to the battery connector on the inside cover flap portion 29*a*. The inside cover 29 is wrapped around the battery 20 without closing the snap portions 33*a*, 33*b*. The loose portions of the outside cover 23 are respectively wrapped around the inside cover 29 and the battery 20 to engage the loop portions 25, 27 in the hook portion 31. The light emitting elements 17, 19 are activated by engaging the snap closure portions 33*a*, 33*b*.

Figure 3:
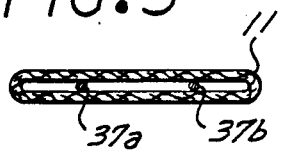
FIG. 3 is a sectional view through the shoelace structure of FIG. 1 along the section lines 3 in FIG. 1.

Referring now to the sectional view of FIG. 3, the flexible shoelace 11 is of known tubular construction, for example, of a flexible fabric material. Two wires 37*a*, 37*b* are disposed within the shoelace 11 and are connected to the light emitting element 17.

Figure 4:
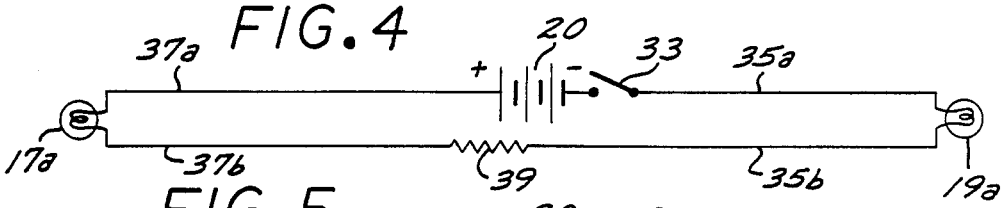
FIG. 4 is a circuit schematic of the illumination circuitry for the shoelace of FIG. 1 having incandescent light-emitting elements.

Referring now to the circuit schematic of FIG. 4, the circuit of the shoelace structure 10 includes the battery 20 and a switch 33 which comprises the snap closure portions 33*a*, 33*b*. One side of the switch 33 is coupled to the negative terminal of the battery 20, while the other side of the switch 33 is coupled to the wire 35*a*. The wire 35*a* is also coupled to an incandescent light emitting element 19*a*. The incandescent light emitting element is further coupled to a wire 35*b* which is coupled to one terminal a current limiting resistor 39. The other terminal of the resistor 39 is coupled to the wire 37*b*. An incandescent light emitting element 17*a* is coupled to the wire 37*b* and also to the wire 37*a* which is coupled to the positive terminal of the battery 20 via the battery connector (not shown) on the inside of the flap section 29*b*. The foregoing wires and the resistor 39 are disposed within the shoelace 11.

Figure 5:
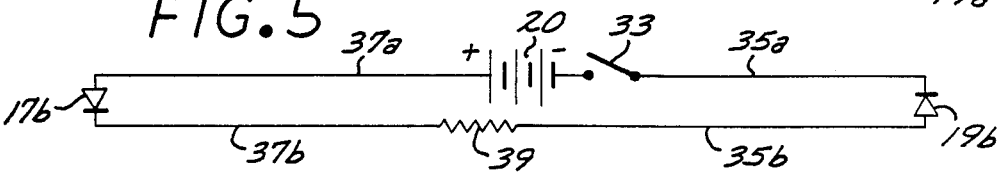
FIG. 5 is a circuit schematic of the illumination circuitry for the shoelace of FIG. 1 having light-emitting diodes (LED's) as the light-emitting elements.

The circuit schematic of FIG. 5 illustrates a further embodiment of the circuit of the shoelace structure 11 which utilizes light emitting diodes (LED's) as the light emitting elements 17, 19 (FIG. 1). The circuit of FIG. 5 is similar to the circuit of FIG. 4, with LED's 17*b*, 19*b* being utilized as the light emitting elements.

Figure 6:
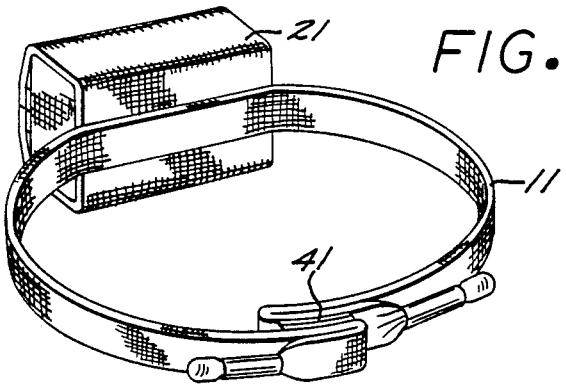
FIG. 6 is a perspective view of a further embodiment of the invention which is directed to a selectively closeable band which may be worn about an ankle or a wrist.

Referring now to FIG. 6, shown therein is a further embodiment of the invention which is directed to a selectively closeable band 30 that may be worn, for example, around an ankle or wrist. The band 30 is similar to the shoelace structure 30 of FIG. 1, and further includes a fastener 41 which includes respective mating fastener portions secured near the ends of the shoelace 11. By way of example, the fastener 51 may comprise a hook and loop fastener system such as those marketed under the mark Velcro.

By way of example, the foregoing illuminated shoe lace or band can be made as follows. Appropriately sized wires and the current limiting resistor are inserted in a section or strip of shoe lace material. The light emitting diodes, or the incandescent lamps, are connected to the wires, for example by soldering. At each end, the terminal portion of the shoelace fabric is pulled over the wires and the leads of the illuminating element, and a metal casing is slipped over the terminal portion of the shoelace material and clamped. Shrink wrap material is placed over the metal casing and the base of the illuminating elements and heated to provide a tight fitting shoelace tip.

Although the foregoing has been a description and illustration of specific embodiments of the invention, various modifications and changes thereto can be made by persons skilled in the art without departing from the scope and spirit of the invention as defined by the following claims.

What is claimed is:

1. A light-emitting article comprising:

an elongated section of flexible material having first and second ends;

a battery holder for containing a battery, said battery holder having an integral electrical switch and being secured to said elongated section of flexible material;

first and second light-emitting elements respectively secured to said first and second ends of said elongated section of flexible material and extending generally axially outwardly therefrom;

conductive means coupled between said battery holder and said light-emitting elements for conductively coupling the contained battery to said first and second light emitting elements; and fastening means for securing portions of said elongated section to form a closed loop.

2. A light-emitting article comprising:

an elongated section of flexible material having first and second ends;

a battery holder secured to said elongated section of flexible material for containing a battery and including an integral elecrical switch, said battery holder comprising a cover having engageably closable flaps and snap portions secured to said flaps, said snap portions comprising said integral electrical switch;

first and second light-emitting elements respectively secured to said first and second ends of said elongated section of flexible material and extending generally axially outwardly therefrom;

conductive means coupled between said battery holder and said light-emitting elements for conductively coupling the contained battery to said first and second light emitting elements; and fastening means for securing portions of said elongated section to form a closed loop.

3. Illuminatible shoe lace apparatus comprising:

an elongated, hollow, flexible shoe lace body member having oppositely disposed first and second open tip portions;

electrically conductive lead wires extending longitudinally through the interior of said shoe lace body from adjacent said first tip portion to adjacent said second tip portion;

first and second electrically energizable light-emitting elements operatively secured to opposite end portions of said lead wires for receiving electrical current transmitted therethrough, said first and second light-emitting elements respectively projecting outwardly from said first and second tip portions;

first and second clamping elements outwardly circumscribing and clamped to said first and second tip portions, respectively, for preventing movement of said opposite end portions of said lead wires outwardly through said first and second tip portions;

a battery holder structure externally carried by a longitudinally central portion of said shoe lace body for removably holding an electrical storage battery, said battery holder structure having terminal portions, operatively connected to said lead wires and engageable by the storage battery, for flowing electrical current from the storage battery into and through said lead wires to energize said light-emitting elements; and a switch element connected to said lead wires and manually operable to selectively initiate and terminate battery current flow therethrough.

4. The apparatus of claim 3 wherein:

said battery holder structure includes a cover portion having engageably closable flaps, and said switch element is defined by mating closure snap elements secured to said flaps.

5. The apparatus of claim 3 wherein:

said first and second light-emitting elements comprise incandescent lamp elements.

6. The apparatus of claim 3 wherein:

said first and second light-emitting elements comprise light-emitting diodes.

7. The apparatus of claim 3 further comprising:

a current limiting resistor operatively connected in one of said lead wires.

8. An illuminatible wearing apparel item comprising:

an elongated, hollow, flexible body member having opposite end portions;

electrically energizable light-emitting means externally carried by said body member for illuminating a portion thereof;

current conducting means, positioned within said body member, for conducting electrical energy from a source thereof to said light-emitting means to energize the same;

switch means operatively associated with said current conducting means and manually operable to selectively initiate and terminate electrical current flow therethrough; and battery holder means, externally secured to a longitudinally intermediate portion of said body member, for releasably holding an electrical storage battery and operatively connecting it to said current conducting means to flow electrical current therethrough, said battery holder means including:

first and second transversely oriented strip portions foldable in transverse directions over the battery to a housing configuration in which the battery is substantially enveloped by the folded strip portions; and cooperating means on said strip portions for releasably holding them in said housing configuration.

9. The wearing apparel item of claim 8 further comprising:

means for releasably connecting said opposite end portions of said body member.

10. The wearing apparel item of claim 8 wherein:

said item is a shoelace, and said light-emitting means comprise a duality of light-emitting elements secured to and projecting axially outwardly from the opposite ends of said body member.

11. The wearing apparel item of claim 8 wherein:

said first and second strip portions have side surface portions, and said cooperating means include cooperating hook and loop fastening sections secured to said side surface portions.

12. The wearing apparel item of claim 8 wherein: said cooperating means include mating snap members secured to opposite ends of one of said first and second strip portions.

13. The wearing apparel item of claim 12 wherein:

said switch means are defined by said mating snap members.

* * * * *